United States Patent [19]

Budzich

[11] 4,436,019

[45] * Mar. 13, 1984

[54] PRESSURE COMPENSATED FLUID CONTROL VALVE

[75] Inventor: Tadeusz Budzich, Moreland Hills, Ohio

[73] Assignee: Caterpillar Tractor Company, Peoria, Ill.

[ * ] Notice: The portion of the term of this patent subsequent to Mar. 13, 2001 has been disclaimed.

[21] Appl. No.: 294,606

[22] Filed: Aug. 20, 1981

[51] Int. Cl.[3] ..... F15B 13/04

[52] U.S. Cl. ..... 91/446; 60/427; 60/452; 91/421; 137/596.1; 137/596.13

[58] Field of Search ..... 60/427, 452; 91/420, 91/421, 446; 137/596.1, 596.13

[56] References Cited

U.S. PATENT DOCUMENTS

| | | | |
|---|---|---|---|
| Re. 29,538 | 2/1978 | Budzich | 91/446 |
| 4,153,075 | 5/1979 | Budzich | 137/596.13 |
| 4,180,098 | 12/1979 | Budzich | 91/421 X |
| 4,282,898 | 8/1981 | Harmon | 91/446 X |
| 4,327,627 | 5/1982 | Budzich | 91/446 |
| 4,333,389 | 6/1982 | Budzich | 91/446 |
| 4,362,087 | 12/1982 | Budzich | 137/596.1 X |

*Primary Examiner*—Gerald A. Michalsky

*Attorney, Agent, or Firm*—Sixbey, Friedman & Leedom

[57] ABSTRACT

A direction flow control valve for control of positive and negative loads operated by a single pilot valve stage, which automatically maintains a relatively constant pressure differential across valve spool, while controlling positive and negative loads and which permits variation in the level of pressure differential in response to an external control signal, while this pressure differential is maintained constant at each controlled level.

32 Claims, 3 Drawing Figures

$P_{IP} - P_{WP} = \Delta P_{yP}$ $P_{IP} - P_2 = \Delta P$ $P_{WP} - P_2 = \Delta P_x$ $\therefore \Delta P_{yP} = \Delta P - \Delta P_x$ $P_{WN} - P_1 = \Delta P_{yN}$ $P_{WN} - P_2 = \Delta P$ $P_1 - P_2 = \Delta P_x$ $\therefore \Delta P_{yN} = \Delta P - \Delta P_x$ $P_1 - P_{WP} = \Delta P_{yP}$
$P_1 - P_2 = \Delta P$
$P_{WP} - P_2 = \Delta P_x$
$\therefore \Delta P_{yP} = \Delta P - \Delta P_x$ $P_{WN} - P_1 = \Delta P_{yn}$
$P_{WN} - P_2 = \Delta P$
$P_1 - P_2 = \Delta P_x$
$\therefore \Delta P_{yN} = \Delta P - \Delta P_x$

PRESSURE COMPENSATED FLUID CONTROL VALVE

BACKGROUND OF THE INVENTION

This invention relates generally to fluid control valves provided with positive and negative load compensation.

In more particular aspects this invention relates to pressure compensated direction and flow control valves, the positive and negative load compensators of which are controlled by a single amplifying pilot valve stage.

In still more particular aspects this invention relates to pilot operated pressure compensated controls of direction control valves, used in control of positive and negative load, which permit variation in the level of control differential across metering orifices of the valve spool, while this control differential is automatically maintained constant at each controlled level.

In still more particular aspects this invention relates to pilot operated pressure compensated controls of direction control valves, for control of positive and negative loads, which permit variation in the controlled pressure differential, across metering orifices of the valve spool, in response to an external control signal.

Closed center fluid control valves, pressure compensated for control of positive and negative loads, are desirable for a number of reasons. They permit load control with reduced power losses and therefore, increased system efficiency. They also permit simultaneous proportional control of multiple positive and negative loads. Such fluid control valves are shown in my U.S. Pat. Nos. 4,180,098, issued Dec. 5, 1979 and also 4,222,409, issued Sept. 16, 1980. However, the valves of those patents although capable of proportional control of positive and negative loads, use for such control the energy directly transmitted through the load pressure sensing ports, which not only attenuate the control signals, but limit the response of the control, those valves also automatically maintain a constant pressure differential across metering orifices in control of both positive and negative loads.

SUMMARY OF THE INVENTION

It is therefore a principle object of this invention to provide an improved pressure compensated valve, equipped for positive and negative load compensation, in which the positive and negative load compensator is controlled by a single amplifying pilot valve stage, which permits variation in the level of control differential across metering orifices of the valve spool, while this control differential is automatically maintained constant at each controlled level.

Another object of this invention is to provide pilot operated pressure compensated controls of a direction control valve, through which control of system positive or negative load can be either accomplished by variation in areas of the orifices between the valve controls and the fluid motor, while the pressure differential across those orifices is maintained constant at a specific level, or by control of pressure differential, acting across those orifices, while the area of those orifices remains constant.

It is a further object of this invention to provide pilot operated pressure compensated controls of a direction control valve, adapted to control both positive and negative loads, which permit variation in the controlled pressure differential, across metering orifices, in response to the external control signal.

It is a further object of this invention to provide pilot operated pressure compensated controls of a direction control valve, adapted to control positive and negative loads and pilot operated output flow controls of a pump, both the controls of the direction control valve and of the pump permitting variation in the controlled pressure differential, across metering orifices, in response to the external control signal.

Briefly the foregoing and other additional objects and advantages of this invention are accomplished by providing novel pressure compensated controls of a direction control valve, to throttle fluid supplied either from the pump or from the fluid motor, either in response to one control input, namely variation in the area of metering orifices, to control a constant pressure differential, at a preselected level developed across those orifices, or in response to another control input, namely modification in the pressure of control signals, to vary the level of the control differential developed across the control orifices, while this control differential is automatically maintained constant at each controlled level by the valve controls, receiving low energy signals to their amplifying stage. In this way a load can be controlled in response to either input, providing identical control performance, or the variable pressure differential control can be superimposed on the control action controlling a positive or negative load by variation in the areas of the metering orifices. Therefore this control system lends itself well to an application in which manual control input from an operator may be modified by an electronic computing circuit.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
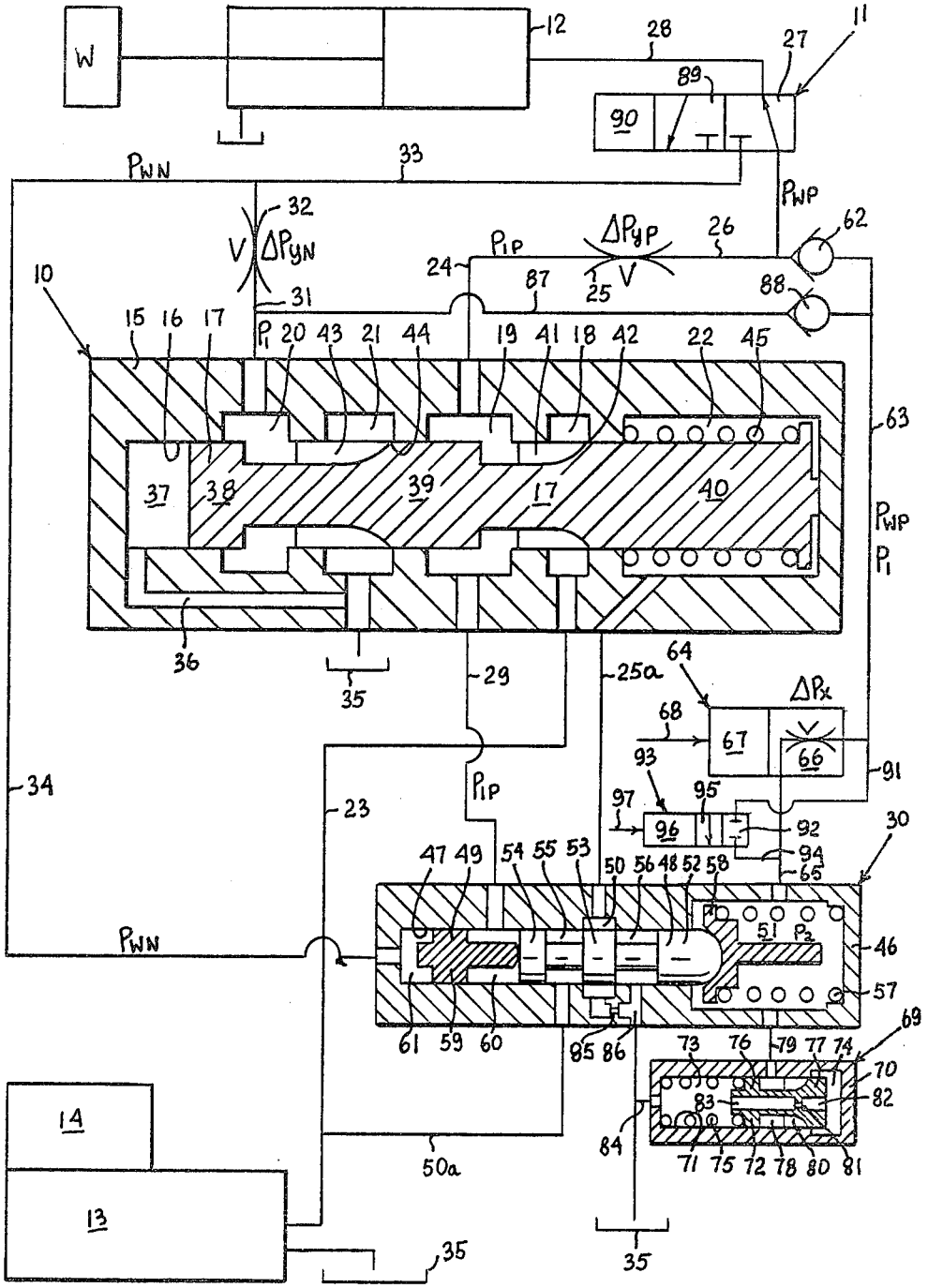
FIG. 1 is a diagrammatic representation of the control elements of a pilot operated positive and negative load throttling control for adjustment in the level of control differential from a certain preselected level to zero level, with fluid motor, direction control valve and system pump shown schematically.

Referring now to the drawings and specifically to FIG. 1, a throttling valve assembly, generally designated as 10, is interposed between a schematically shown 3 way, 2 position valve, generally designated as 11, connected to a fluid motor 12 and a pump 13, provided with fluid flow control 14. The throttling valve assembly 10 comprises a housing 15 provided with a bore 16 guiding in sliding engagement a throttling spool 17. Bore 16 communicates with inlet chamber 18, supply chamber 19, outlet chamber 20, exhaust chamber 21 and control chamber 22. The inlet chamber 18 is connected through discharge line 23 with the pump 13. The supply chamber 19 is connected through line 24, variable orifice 25, line 26 and section 27 of the valve 11 and line 28 with the fluid motor 12 and is also connected through line 29 with the pilot valve assembly, generally designated as 30. The outlet chamber 20 is connected through line 31, variable orifice 32, line 33 to the section 27 of the valve 11 and also connected by line 34 to the pilot valve assembly 30. The exhaust chamber 21 is connected to system reservoir 35 and is also connected through passage 36 with space 37. Control chamber 22 is connected to the pilot valve assembly 30 by line 25*a*. The throttling spool 17 is provided with lands 38, 39 and 40 and positive load throttling slots 41, provided with throttling edges 42 and positioned between the inlet chamber 18 and the supply chamber 19. The throttling spool 17 is also provided with negative load throttling slots 43, provided with throttling edges 44 and positioned between the outlet chamber 20 and the exhaust chamber 21. The land 40 of the throttling spool 17, projects into the control chamber 22 and is biased by control spring 45, while the land 38 and bore 16 define space 37. The pilot valve assembly 30 comprises a housing 46 provided with a bore 47, slidably guiding a spool 48 and a free floating piston 49, annular space 50 and control space 51. The pilot valve spool 48 has lands 52, 53 and 54, defining annular spaces 55 and 56. The land 52 projects into control space 51 and is biased by a pilot valve spring 57, through a spring retainer 58. The land 54 is selectively engageable by the free floating piston 49, provided with land 59, which defines spaces 60 and 61. Line 26, upstream of variable orifice 25, is connected, through a signal check valve 62 and line 63, with the signal throttling valve, generally designated as 64, which in turn is connected by line 65 with control space 51 of the pilot valve assembly 30. The signal throttling valve 64 is provided with variable orifice section 66 and an actuating section 67, responsive to an external control signal 68. A flow control section, generally designated as 69, is interposed between control space 51 and the system reservoir 35 and comprises a housing 70, provided with a bore 71, guiding a flow control spool 72, which defines spaces 73 and 74 and which is biased by a spring 75. The flow control spool 72 is provided with lands 76 and 77, defining annular space 78, which is connected by line 79 with control space 51. The flow control spool 72 is also provided with throttling slots 80 and leakage orifice 81, which communicates through passages 82 and 83, space 74 with space 73, space 73 being connected by line 84 with system reservoir 35. Annular space 50 is connected by leakage orifice 85 with port 86, leading to annular space 56 and connected to the system reservoir 35. Line 31, down stream of variable orifice 32, is connected by line 87 with a signal check valve 88, which in turn is connected by line 63 to the signal throttling valve 64. The valve 11 is provided with section 27 and also section 89, both of those sections being operable by an actuating section 90. Line 63 connects, down stream of signal check valves 62 and 88, with line 91, connected to a cut-off section 92 of the cut-off valve, generally designated as 93. The cut-off section 92 is also connected by line 94 with line 65, which connects variable orifice section 66, of the signal throttling valve 64, with control space 51. The cut-off valve 93 is also provided with a connecting section 95, which, together with cut-off section 92, are operated by the actuating section 96, responsive to an external control signal 97.

Figure 2:
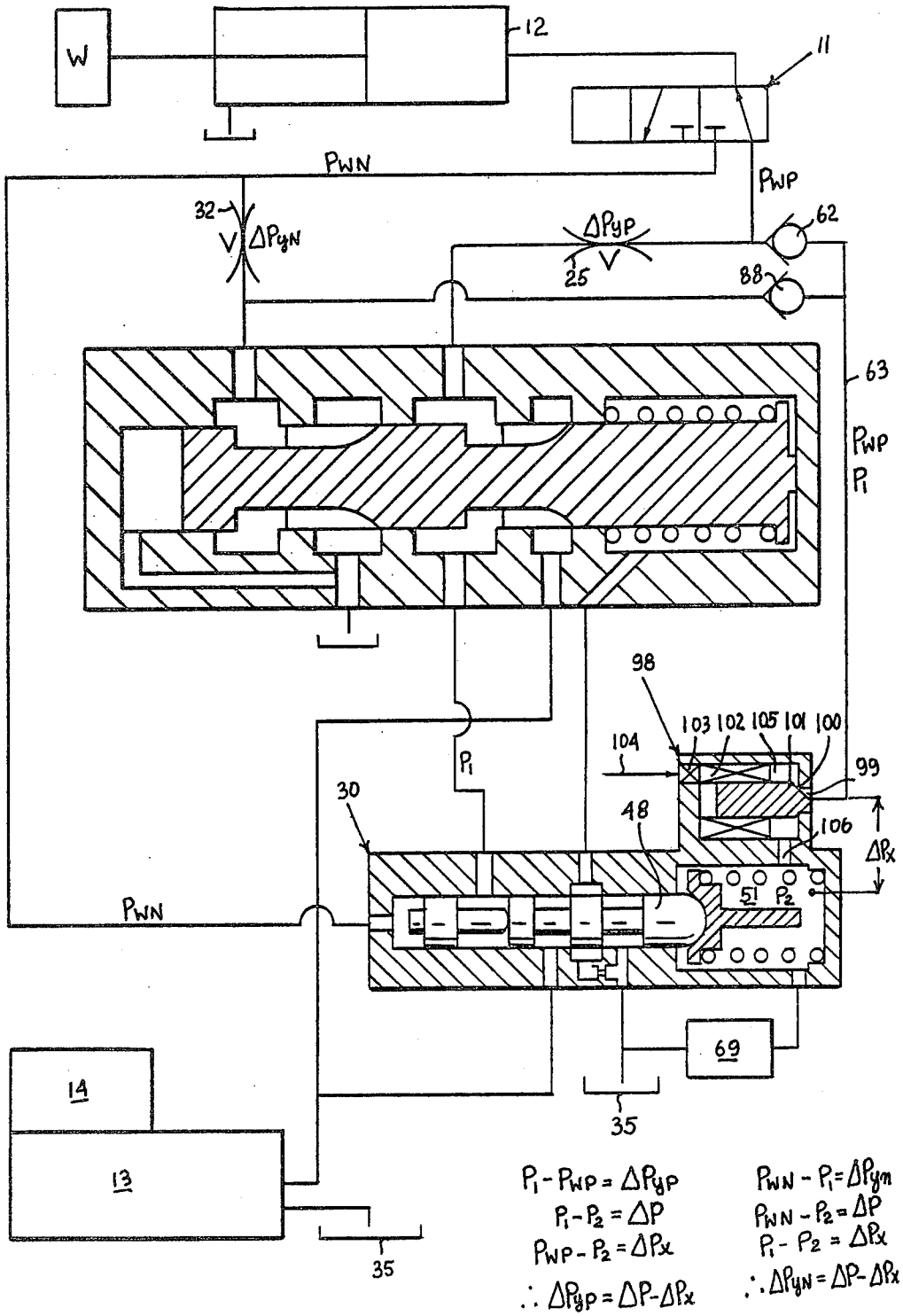
FIG. 2 is a diagrammatic representation of another embodiment of the pressure compensated pilot operated control of FIG. 1, with fluid motor, direction control valve and system pump shown schematically.

Referring now to FIG. 2, the same components as shown in FIG. 1 are denoted by the same numerals. Line 63 connects down stream of signal check valves 62 and 88 with the throttling valve, generally designated as 98, which throttles fluid, at signal pressure, supplied to the control space 51. Line 63 communicates with port 99, provided with a seat 100, which provides an area of throttling orifice in conjunction with an armature 101, slidably guided in a coil 102, which is connected by a connector 103, to which an external control signal 104 is applied. Space 105 is connected by passage 106 to control space 51.

Figure 3:
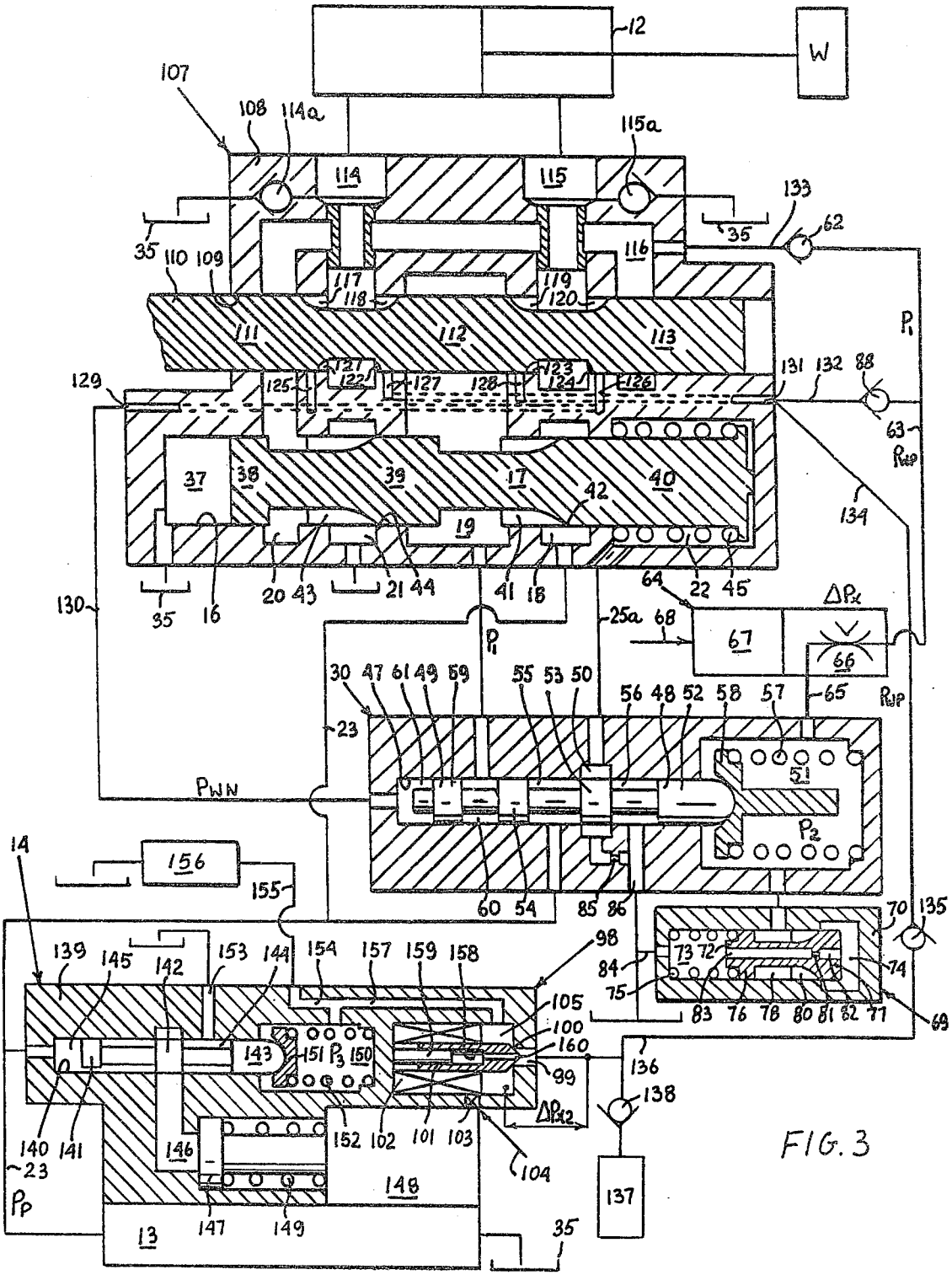
FIG. 3 is a sectional view of an embodiment of a flow control valve provided with a single positive and negative load compensator, also showing a longitudinal sectional view of an embodiment of a pilot valve amplifying stage controlling the compensator, with diagrammatically shown controls of the flow changing mechanism of the system pump and with fluid motor and other system valves shown schematically.

Referring now to FIG. 3, the same components as shown in FIGS. 1 and 2 are denoted by the same numerals. A flow control valve assembly, generally designated as 107, provided with a throttling section, identical to that as shown in FIG. 1, is interposed between the fluid motor 12 and the pump 13. The flow control valve 107 is of a four way type and has a housing 108 provided with bore 109, axially guiding a valve spool 110. The valve spool 110 is equipped with lands 111, 112 and 113, which in neutral position of the valve spool 110, As shown in FIG. 3, isolates the fluid supply chamber 19, load chambers 114 and 115 and outlet chambers 20 and 116. Lands 111, 112 and 113 of the valve spool 110, are provided with metering slots 117, 118, 119 and 120 and timing slots 121, 122, 123 and 124. Negative load sensing ports 125 and 126 are positioned between load chambers 114 and 115 and outlet chambers 20 and 116. Positive load sensing ports 127 and 128 are located between supply chamber 19 and the load chambers 114 and 115. The load chambers 115 and 114 are connected through one way check valves 115*a* and 114*a* with the system reservoir 35.

The negative load sensing ports 125 and 126 are connected through passage 129 and line 130 with space 61 of the pilot valve assembly 30. The positive load sensing ports 127 and 128 are connected through passage 131 and line 132 to the signal check valve 88. The outlet chamber 116 is connected by line 133 with the signal check valve 62. The signal check valve 62 and 88 are phased, in a manner as previously described, by line 63 to the control system including the signal throttling valve 64 and the pilot valve assembly 30. Passage 131, connected to the positive load sensing ports 127 and 128, is also connected by line 134, a check valve 135 and signal line 136 to the fluid flow control of the pump 13, generally designated as 14. A schematically shown circuit 137, including flow control valves, similar to the flow control valve 107, is connected by a check valve 138 to signal line 136. The pump flow control 14 comprises a housing 139 provided with a bore 140, axially guiding pilot spool 141, which has lands 142 and 143, defining annular space 144 and space 145. Bore 140 is intersected by control port 146, which is in direct communication with a control piston 147 of a flow changing mechanism 148 of the system pump 13. The control piston 147 is biased towards position of maximum flow by a spring 149. The land 143 projects into control space 150 and with its spherical end engages a spring retainer 151, guiding a spring 152. Space 145 is directly connected to pump discharge line 23. Annular space 144 is connected by port 153 with system reservoir. Control space 150 is connected by passage 154 and line 155 to a leakage device 156, which may be in the form of a fixed throttling orifice, or a flow control valve, similar to flow control valve 69. Control space 150 is also connected by passage 157 to space 105 of the throttling valve, generally designated as 98 and similar to the throttling valve 98 of FIG. 2. The throttling valve 98 throttles fluid supplied by signal line 136. Line 136 communicates with port 99, provided with the seat 100, which provides an area of throttling orifice in conjunction with the armature 101, slidably guided in the coil 102, which is connected by the connector 103, to which the external control signal 104 is applied. The armature 101 is provided with bore 158, slidably guiding a balancing pin 159, which is subjected through passage 160 to the pressure existing in port 99.

Referring now back to FIG. 1, assume that the 3 way, 2 position valve 11 with its actuating section 90 is in position as shown in FIG. 1, connecting the fluid power and control system to the fluid motor 12, subjected to positive load W and that the variable orifice 25 is closed, isolating the supply chamber 19 from the fluid motor. The load pressure Pwp will open the signal check valve 62, close the signal check valve 88 and will be transmitted through lines 63 and 91 to the signal throttling valve 64 and the cut-off valve 93. Assume also that the cut-off valve 93 is actuated by the actuating section 96, so that the connecting section 95 directly connects line 91 with lines 94 and 65 thus, completely bypassing the signal throttling section 64. The load pressure Pwp will be then directly transmitted to control space 51 with P2 becoming Pwp pressure. Control space 51 is connected through the flow control section 69 with the system reservoir 35. In a well known manner, the flow control spool 72 will automatically assume a throttling position, throttling the fluid from control space 51 at Pwp or P2 pressure to a pressure, equivalent to the preload of spring 75. Therefore space 74 will be always maintained at a constant pressure as dictated by the preload in the spring 75. Space 74 is connected through passage 82, leakage orifice 81 and passage 83 with space 73, connected to system reservoir. Therefore, with constant pressure differential automatically maintained across leakage orifice 81, a constant flow, at a certain preselected minimum level, will take place from space 74 and control space 51, irrespective of the level of Pwp or P2 pressure. Therefore, with the signal throttling valve 64 bypassed by the cut-off valve 93, P2 pressure will always equal Pwp pressure. The pilot spool 48 is subjected to Pwp pressure in the control space 51, preload of the pilot valve spring 57 and pressure Pip in space 60, which is connected to the supply chamber 19, which in turn is connected, through positive load throttling slots 41, with the inlet chamber 18, connected by discharge line 23 to the pump 13. Under the action of those forces the pilot valve 48 will move into a modulating position, as shown in FIG. 1, regulating the pressure in the control chamber 22 and therefore position of the throttling spool 17, throttling by throttling edges 42 the fluid flow from the inlet chamber 18 to the supply chamber 19, to maintain a constant pressure differential between space 60 and control space 51, equivalent to preload of the pilot valve spring 57. The free floating piston 49, subjected to pressure differential between spaces 60 and 61, will move all the way to the left, out of contact with the pilot spool 48. Since the variable orifice 25 is closed the throttling spool 17 will assume a position, in which throttling edges 42 will completely isolate the inlet chamber 18 from the supply chamber 19.

Assume that variable orifice 25 is now open providing a specific flow area. Fluid flow will take place from the supply chamber 19, through variable orifice 25, to the fluid motor 12, the pilot valve assembly automatically throttling, through the position of the throttling spool 17, the fluid flow from the inlet chamber 18 to the supply chamber 19, to maintain a constant pressure differential of $\Delta Pyp$ equal to $\Delta P$, which in turn is equal to the quotient of the preload of the pilot valve spring 57 and the cross-sectional area of the pilot spool 48. Since a constant pressure differential is maintained across variable orifice 25, a constant flow of fluid will be supplied to fluid motor 12, irrespective of the variation in the magnitude of the load W. Therefore under those conditions the flow to the fluid motor 12 becomes directly proportional to the flow area of the variable orifice 25 and independent of Pwp pressure.

Assume that while controlling a positive load W, in a manner as described above, the cut-off valve 93 was actuated into its cut-off position, as shown in FIG. 1. Then the fluid flow into control space 51, at a level as dictated by the setting of the flow control section 69, must pass through the variable orifice section 66 of the signal throttling valve 64. Assume that in the variable orifice section 66 the constant fluid flow, delivered to control space 51, is throttled, the pressure differential $\Delta Px$ being developed across the variable orifice section 66. Then the control space 51 will be subjected to P2 pressure which is equal to the difference between Pwp pressure and $\Delta Px$. It can be seen that $\Delta Pyp = -Pip - Pwp$, $Pip - P2 = \Delta P$, which is the constant pressure differential caused by the preload of the pilot valve spring 57 and that $Pwp - P2 = \Delta Px$. Those equations are tabulated in a column in bottom left hand corner of FIG. 1. From the above three equations, when substituting and eliminating Pip, Pwp and P2 pressures, the basic relationship of $\Delta PyP = \Delta P - \Delta Px$ is obtained. With $\Delta Px = 0$ which is the case, as explained above, when the signal throttling valve 64 is bypassed by the cut-off valve 93, $\Delta Pyp = \Delta P$ and the flow to the fluid motor is controlled at maximum constant pressure differential. Any value of $\Delta Px$, as can be seen from the basic equation, will automatically lower, by the same amount, $\Delta Pyp$, acting across variable orifice 25, automatically reducing the quantity of fluid flow to the fluid motor 12, this flow still being maintained constant at a constant level and independent of the variation in the magnitude of load W. Therefore, by controlling the value of $\Delta Px$, by the signal throttling valve 64, the pressure differential $\Delta Pyp$ is controlled, controlling the velocity of load W. In a similar way the velocity of the load W and therefore the flow into the fluid motor 12 can be controlled by the variaton in the area of variable orifice 25, at any controlled level of $\Delta Pyp$, as dictated by the value of $\Delta Px$. Therefore, the flow control system of FIG. 1 becomes a dual input control system, in which one control input can be superimposed upon the other, providing a unique positive load control system. The control of $\Delta Px$, by the signal throttling valve 64, is done by the actuating section 67, in response to an external control signal 68, which requires a very low energy level and might be supplied from an electronic computing circuit.

Assume that the 3 way, 2 position valve 11 was actuated by the actuating section 90, connecting through the section 89 the fluid motor 12 with line 33, while disconnecting the fluid motor 12 from the system pump. Then the load W will automatically become negative. Assume that variable orifice 32 is closed. Then the pressure signal at Pwn pressure will be transmitted to space 61 and react on the cross-sectional area of the free floating piston 49. Assume also that with variable orifice 25 closed no pressure signal is transmitted through line 63 and that control space 51 is subjected to reservoir pressure, by the action of the flow control section 69. The pilot spool 48 will be displaced by the free floating piston 59 all the way to the right, connecting annular space 50 and the control chamber 22 with annular space 55, subjected to pump discharge pressure through line 50*a*. The throttling spool 17 will automatically move all the way from right to left, with the throttling edges 44 cutting off communication between the exhaust chamber 21 and the outlet chamber 20 and therefore isolating down stream of the variable orifice 32 from the system reservoir 35. Assume that the cut-off valve 93 was actuated by the actuating section 96, with the connecting section 95 connecting line 91 with lines 94 and 65 and therefore completely bypassing the signal throttling valve 64. Assume also that variable orifice 32 was open to a position, equivalent to a specific area of the orifice. With the throttling spool 17 blocking the outlet chamber 20 from the exhaust chamber 21, the negative load pressure will be automatically transmitted through line 87, will open the signal check valve 88, close the signal check valve 62 and will be transmitted through lined 63 and 91, the connecting sectin 95 and lines 94 and 65 to the control space 51. The Pwn pressure in control space 51 will react on the cross-sectional area of pilot spool 48, the pilot valve spring 57 bringing it into its modulating position, as shown in FIG. 1 and controlling the pressure in the control chamber 22, to establish a throttling position of the throttling spool 17, which will maintain a constant pressure differential across metering orifice 32, as dictated by the preload of the pilot valve spring 57. Then $Pwn-P2$ will equal constant $\Delta P$, which is equal to the quotient of the preload of the pilot valve spring 57 and the cross-sectional area of the pilot spool 48. Since a constant pressure differential of $\Delta Pyn=\Delta P$ is maintained across the variable orifice 32, flow out of the fluid motor 12 will be proportional to the area of the variable orifice 32 and independent of the magnitude of the negative load W. Therefore in this way, by varying the flow area of the flow orifice 32, the velocity of the load W can be controlled, each area of orifice representing a specific constant flow level, independent of the magnitude of the load W.

Assume that the cut-off valve 93 was actuated back to its cut-off position, as shown in FIG. 1 and that the constant flow, as dictated by the constant flow setting of the flow control section 69, is passed through the variable orifice section 66, resulting in a $\Delta Px$ pressure drop in Pi pressure. Therefore, $Pi-P2=\Delta Px$, $Pwn-P2=\Delta P$ and $Pwn-Pi=\Delta Pyn$. Those relationships are tabulated in the lower right hand corner of FIG. 1. When substituting and eliminating Pi and P2 and Pwn pressures, the basic relationship of $\Delta Pyn=\Delta P-\Delta Px$ can be established. With $\Delta Px=0$, which is the case with the cut-off valve 93 in an open position, as already described above, $\Delta Pyn$ assumes its maximum constant value equal to $\Delta P$. With the cut-off valve 93 in its cut-off position, as shown in FIG. 1, by controlling the value of $\Delta Px$, in response to the external control signal 68, the value of $\Delta Pyn$ can be controlled from maximum to zero, each constant value of $\Delta Pyn$, at any specific flow area of flow orifice 32, representing a specific constant flow at a specific level from the fluid motor 12 and independent of the magnitude of the load W. Therefore the fluid control system of FIG. 1 represents a dual input control system, which will control, in an identical fashion, both positive and negative loads, while using a single pilot valve assembly 30. During control of positive load the free floating piston 49 is forceably maintained by a pressure differential out of contact with the pilot spool 48. During control of negative load the free floating piston 49 acts together with the pilot spool 48. During control of positive load the pressure differential, across the variable orifice 25, is controlled by the throttling action of positive load throttling slots 41. During control of negative load the pressure differential, across the variable orifice 32, is maintained by the throttling action of the negative load throttling slots 43. During the control of both positive and negative loads pressure differential, acting across controlling orifice can be varied by the signal throttling valve 64. Both for control of positive and negative loads the control system of FIG. 1 becomes a dual input control system, in which the velocity of the load can be controlled either by variation in the area of the controlling orifice or by variation in pressure differential acting across the controlling orifice. Those two control signals can be superimposed one upon the other, providing a unique compensated flow control, independent of the magnitude of the positive and negative loads. While controlling positive and negative loads, through the variable pressure differential mode of control, a very low energy external control signal can be used, making this control suitable for the input from electronic computing circuits. When controlling a positive or negative load, through the dual input control system, the control may be made to revert instantly to the single control input mode of operation by actuation of the cut-off valve 93.

Referring now to FIG. 2 the basic control components of the valve assembly are identical to those of FIG. 1. The only difference between FIGS. 1 and 2 is that the signal throttling valve 64 was substituted by throttling valve 98 and the cut-off valve 93 of FIG. 1 dispensed with. Basically the throttling valve 98 of FIG. 2 modifies the control signals, transmitted to the pilot valve assembly 30 and provides the same end performance as the arrangement of FIG. 1, although some of the control characteristics of the control of FIG. 2 are preferable. The pressure signal in line 63 is throttled at the seat 100 by the armature 101 of a solenoid, the coil 102 of which is provided with a variable current input, shown as an external control signal 104. By regulating the current flow, the force transmitted to the armature 101 is varied, therefore varying the amount of the throttling action and controlling the pressure drop $\Delta Px$. The control space 51 is still connected to the system reservoir 35 by flow control section 69, shown in detail in sectional view of FIG. 1. In FIG. 1 the principle of the control operation is based on the fact that a constant flow is maintained from the control space 51, irrespective of the magnitude of the P2 pressure. Then by varying the resistance of the variable orifice section 66 the exact pressure drop $\Delta Px$ is obtained. Change in flow level of the flow control section 69 would effectively change $\Delta Px$. This is not the case with the arrangement of FIG. 2, where $\Delta Px$ is independent of the flow through the flow control section 69, which even might be a simple leakage orifice. The flow control section 69 is provided for one reason only and that is to permit the movement of the pilot spool 48 from left to right, when it displaces some volume of fluid from control space 51. Under those conditions the armature 101 will act as a check valve, preventing flow into line 63, the flow displaced from control space 51 passing through the flow control section 69.

Referring now to FIG. 3, the basic control components shown in FIGS. 1 and 2 are combined in a flow control system with the throttling valve integrated into one assembly with a four way direction control valve. The pilot valve assembly 30, the flow control section 69, the signal throttling valve 64 of FIGS. 1 and 3 are identical and perform identical control of functions and so is the configuration of the throttling valve 10, although in FIG. 3 it is combined into an assembly with the four way direction control valve. The four way direction control valve of FIG. 3 permits the operation of double acting fluid motor 12, as differentiated from the schematically shown 3 way, 2 position valve 11 controlling a single acting fluid motor. While the direction control valve 11 is shown schematically, the four way valve spool 110 of FIG. 3, shown in section, includes many important details.

The displacement of the valve spool 110 from its neutral position in either direction first connects by timing slot 121 or 124 the load chamber 114 or 115 with negative load sensing port 125 or 126, while also connecting load chamber 114 or 115 by signal slot 122 or 123 with the positive load sensing port 127 or 128. Further displacement from neutral position of the valve spool 110 creates a metering orifice through metering slot 117 or 120 with the outlet chamber 20 or 116, while at the same time creating a metering orifice through metering slot 118 or 119 between load chamber 114 or 115 and the supply chamber 19. Those metering orifice perform an identical function as the variable orifices 25 and 32 of FIG. 2, with a controlled pressure differential ΔPyp or Δ Pyn being developed across them. The area of those orifices is controlled by the displacement of the valve spool 110, while the pressure differential across them is controlled, in a manner as previously described, by the flow control section 64, in response to an external control signal 68. The negative load sensing ports 125 and 126 are connected through passage 129 and line 130 with space 61 of the pilot valve assembly 30, providing Pwn reference pressure. The positive load sensing ports 127 and 128 are connected through passage 131, line 132, signal check valve 88, line 63, orifice section 66 and line 65 with the control space 51, providing a reference pressure Pwp to the signal throttling valve 64. The outlet chamber 116 is connected through line 133, signal check valve 62 and line 63 with the signal throttling valve 64, providing it with Pi reference pressure. The positive load pressure signal from the positive load sensing ports 127 and 128 is transmitted through line 134, check valve 135 and signal line 136 to the fluid flow control 14 of the pump 13. If pump 13 is of a fixed displacement type, pump flow changing mechanism 148 is a differential pressure bypass valve, which, in a well known manner, by bypassing fluid from pump 13 to a reservoir 35 maintains discharge pressure of pump 13 at a level, higher by a constant pressure differential than Pwp pressure in signal line 136. If a positive load pressure signal of the flow control valve 137 is higher than that of flow control valve 107, the check valve 135 will seat, the check valve 138 will open and the pump 13 will supply the circuit with discharge pressure, higher by a constant pressure differential, than the new pressure level in the signal line 136. If pump is of a variable displacement type, pump flow changing mechanism 148 is a differential pressure compensator, well known in the art, which by changing displacement of pump 12, maintains discharge pressure of pump 12 at a level, higher by a constant pressure differential, than pressure in signal line 136.

The pump flow changing mechanism 148 is biased towards position of maximum pump flow by the spring 149, acting through the control piston 147. The control piston 147 is directly subjected to pressure in control port 146, which is varied by the control action of the pilot valve spool 141. By changing the pressure level in control port 146 the position of the control piston 147 is regulated, in turn controlling the output flow of the pump 13, each specific position of the control piston 147 corresponding to a specific output flow from the pump. The pilot spool 141 on one side is subjected to the force due to discharge pressure Pp and on the other side to force due to pressure P3 in control space 150, together with the biasing force of the spring 152. Subjected to those forces the pilot spool 141 will assume a modulating position, as shown in FIG. 3, controlling the pressure in control port 146 and therefore the output flow of the pump, to maintain a constant pressure differential between its discharge pressure Pp and pressure P3 in control space 150. This constant pressure differential, as it is well known in the art, will be equal to the quotient of the preload of the spring 152 and the cross-sectional area of the pilot spool 141. Assume that the throttling effect of the throttling valve 98 is $\Delta Px2=0$. Then $P3=Pwp$ and the pump control will automatically maintain a constant pressure differential between its discharge pressure Pp and the positive load pressure Pwp, transmitted through the positive load pressure sensing circuit from the positive load sensing ports 127 or 128. Let $\Delta P=Pp-P3$, $\Delta Px2=Pwp-P3$ and $\Delta Py=Pp=Pwp$, where ΔPy is the effective pressure differential between pump discharge pressure and positive load pressure. From the above three equations, when substituting and eliminating the terms of Pp, P3 and pwp, the basic equation of $\Delta Py=\Delta Pp-\Delta Px2$ is established. Therefore by controlling the throttling loss in the throttling valve 98, equal to ΔPx2, the effective pressure differential ΔPy, between the pump discharge pressure Pp and the positive load pressure Pwp, can be controlled and maintained constant at any desired specific level. The throttling action of the throttling valve 98 was described in detail when referring to FIG. 2. The level of this throttling action ΔPx2 becomes proportional to the magnitude of the input current, supplied to the coil 102, as denoted by the external signal 104. The throttling valve 98 of FIG. 3 is provided with the balancing pin 159, inside the armature 101, which effectively reduces the magnitude of the input current to be supplied to the coil 102 for any specific value of the throttling loss ΔPx2 .

The control valve of FIG. 3 shows a dual input four way valve assembly, in which the single pilot valve assembly 30 is used to control both positive and negative loads. While controlling a positive or negative load change in external signal 68, in a manner as previously described when referring to FIG. 1, will result in a change of the control differential across the metering orifices of the valve, which control differential will remain constant, at each specific controlled level, controlling velocity of the load W, irrespective of the magnitude of the load. At each specific level of the controlled pressure differential the change in the area of the metering orifices, due to displacement of the valve spool 110, will proportionally vary the flow delivered to the fluid motor 12, irrespective of the change in the magnitude of the positive or negative load W. The same basic equations, developed and shown in FIG. 1, apply to the control of FIG. 3. One of the basic advantages of the configuration of FIG. 3 is the separation of load pressure sensing circuit from the metering circuit, permitting activation of the pilot valve assembly 30 before the actual metering operation takes place.

In the control system of FIG. 3 the velocity of the positive or negative load W can be controlled by position of the valve spool 110, which regulates the area of the variable orifice while the pressure differential, acting across the orifice, is maintained constant by the valve controls. Conversely, for any specific area of the control orifice the pressure differential, acting across the orifice, can be varied and maintained constant at any specific desired level by variation in the external control signal 68. Both of those control actions can be simultaneously performed, can be superimposed one upon the other, are compatible with each other and are independent of the magnitude of the load W, providing a type of hydraulic summing device, or dual input control of great flexibility. This flexibility can be further increased by simultaneous control over the pressure differential between pump discharge pressure and positive load pressure, in response to the external control signal 104. Since the energy levels of the external control signals 68 and 104 are very low, the control system of FIG. 3 lends itself well to interfacing with all types of electronic computing circuits.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having an inlet chamber connected to a pump and an outlet chamber connected to exhaust means, first valve means operable to selectively communicate said inlet and said outlet chambers with a fluid motor, first control orifice means interposed between said inlet chamber and said fluid motor, second control orifice means inerposed between said fluid motor and said outlet chamber, second valve means having positive load fluid throttling means between said inlet chamber and said pump and negative load fluid throttling means between said outlet chamber and said exhaust means, said positive and said negative load fluid throttling means controllable by single pilot valve means and operable to throttle fluid flow by said positive load fluid throttling means to maintain a constant pressure differential at a preselected constant level across said pilot valve means and to maintain a constant pressure differential across said first control orifice means and to throttle fluid flow by said negative load fluid throttling means to maintain a constant pressure differential at a preselected constant level across said single pilot valve means and to maintain a constant pressure differential across said second control orifice means, and valve means having means operable through said positive and said negative load fluid throttling means to vary the level of said constant pressure differential across said first and said second control orifice means while said pressure differential across said pilot valve means remains constant at said constant predetermined level.

2. A valve assembly comprising a housing having an inlet chamber connected to a pump, a supply chamber and an outlet chamber connectable to a fluid motor through a direction control valve means, and an exhaust chamber connected to fluid exhaust means, first control orifice means interposed between said supply chamber and said fluid motor, second control orifice means interposed between said outlet chamber and said fluid motor, positive load fluid throttling means between said inlet chamber and said supply chamber, negative load fluid throttling means between said outlet chamber and said exhaust chamber, single pilot valve means operable through said positive load fluid throttling means to throttle fluid flow from said inlet chamber to said supply chamber and also operable through said negative load fluid throttling means to throttle fluid flow from said outlet chamber to said exhaust chamber to maintain a constant pressure differential at a preselected constant level across said single pilot valve means and to maintain a constant pressure differential across said first and said second control orifice means, and valve means having means operable through said positive and said negative load fluid throttling means to vary the level of said constant pressure differential across said first and said second control orifice means while said pressure differential across said pilot valve means remains constant at said constant predetermined level.

3. A valve assembly as set forth in claim 2 wherein said control orifice means has variable area orifice means.

4. A valve assembly as set forth in claim 2 wherein said valve means includes flow orifice means and a flow control means down stream of said flow orifice means.

5. A valve assembly as set forth in claim 2 wherein said valve means includes fluid throttling means and orifice means down stream of said fluid throttling means communicable with said exhaust means.

6. A valve assembly as set forth in forth in claim 2 wherein said valve means includes fluid throttling means and flow control means down stream of said fluid throttling means.

7. A valve assembly as set forth in claim 2 wherein said valve means has means to vary the level of said constant pressure differential across said first and said second control orifice means below the level of said pressure differential across said single pilot valve means maintained constant at said constant predetermined level.

8. A valve assembly as set forth in claim 2 wherein said valve means has means responsive to an external control signal.

9. A valve assembly as set forth in claim 2 wherein said single pilot valve means has control force generating means responsive to pressure differential across said first control orifice means.

10. A valve assembly as set forth in claim 2 wherein said single pilot valve means has control force generating means responsive to pressure differential across said second control orifice means.

11. A valve assembly as set forth in claim 2 wherein said single pilot valve means has first control force generating means responsive to pressure differential across said first control orifice means and second control force generating means responsive to pressure differential across said second control orifice means.

12. A valve assembly supplied with pressure fluid by a pump, said valve assembly comprising a housing having an inlet chamber, a supply chamber, first and second load chambers and exhaust means connected to reservoir means, first valve means for selectively interconnecting said load chambers with said supply chamber and said exhaust means, first control orifice means responsive to movement of said first valve means and operable to meter fluid flow between said supply chamber and said load chambers, second control orifice means responsive to movement of said first valve means and operable to meter fluid flow between said load chambers and said exhaust means, positive load fluid throttling means between said inlet chamber and said supply chamber, negative load fluid throttling means between said load chambers and said exhaust means, single pilot valve means operable through said positive load fluid throttling means to throttle fluid flow from said inlet chamber to said supply chamber and also operable through said negative load fluid throttling means to throttle fluid flow from said load chambers to said exhaust means to maintain a constant pressure differential at a preselected constant level across said pilot valve means and to maintain a constant pressure differential across said first and said second control orifice means, and valve means having means operable through said positive and said negative load fluid throttling means to vary the level of said constant pressure differential across said first and said second control orifice means while said pressure differential across said pilot valve means remains constant at said constant predetermined level.

13. A valve assembly as set forth in claim 12 wherein said valve means includes flow orifice means and a flow control means down stream of said flow orifice means.

14. A valve assembly as set forth in claim 12 wherein said valve means includes fluid throttling means and orifice means down stream of said fluid throttling means communicable with said exhaust means.

15. A valve assembly as set forth in claim 12 wherein said valve means includes fluid throttling means and flow control means down stream of said fluid throttling means.

16. A valve assembly as set forth in claim 12 wherein said valve means has means to vary the level of said constant pressure differential across said first and said second control orifice means below the level of said pressure differential across said pilot valve means maintained constant at said constant predetermined level.

17. A valve assembly as set forth in claim 12 wherein said valve means has means responsive to an external control signal.

18. A valve assembly as set forth in claim 12 wherein said single pilot valve means has control force generating means responsive to pressure differential across said first control orifice means.

19. A valve assembly as set forth in claim 12 wherein said single pilot valve means has control force generating means responsive to pressure differential across said second control orifice means.

20. A valve assembly as set forth in claim 12 wherein said single pilot valve means has first control force generating means responsive to pressure differential across said first control orifice means and second control force generating means responsive to pressure differential across said second control orifice means.

21. A valve assembly supplied with pressure fluid by a pump, said valve assembly comprising a housing having an inlet chamber, a supply chamber, first and second load chambers, an outlet chamber, a fluid control chamber, and exhaust means connected to reservoir means, first valve means for selectively interconnecting said load chambers with said supply chamber and said outlet chamber, first control orifice means responsive to movement of said first valve means and operable to meter fluid flow between said fluid supply chamber and said load chambers, second control orifice means responsive to movement of said first valve means and operable to meter fluid flow between said load chambers and said outlet chamber, positive and negative load pressure sensing means selectively communicable with said load chambers by said first valve means, second valve means having positive load fluid throttling means between said inlet chamber and said supply chamber, negative load fluid throttling means between said outlet chamber and said exhaust means, and force generating means responsive to pressure in said fluid control chamber, single pilot valve means having means operable to control pressure in said fluid control chamber and operable through said second valve means to throttle fluid flow from said inlet chamber to said supply chamber and to throttle fluid flow from said outlet chamber to said exhaust means to maintain a constant pressure differential at a preselected constant level across said single pilot valve means and to maintain a constant pressure differential across said first and said second control orifice means, and valve means having means operable through said second valve means to vary the level of said constant pressure differential across said first and said second control orifice means while said pressure differential across said pilot valve means remains constant at said constant predetermined level.

22. A valve assembly as set forth in claim 21 wherein said valve means includes orifice means and a flow control means down stream of said flow orifice means.

23. A valve assembly as set forth in claim 21 wherein said valve means includes fluid throttling means and orifice means down stream of said fluid throttling means communicable with said exhaust means.

24. A valve assembly as set forth in claim 21 wherein said valve means includes fluid throttling means and flow control means down stream of said fluid throttling means.

25. A valve assembly as set forth in claim 21 wherein said valve means has means to vary the level of said constant pressure differential across said first and said second control orifice means below the level of said pressure differential across said pilot valve means maintained constant at said constant predetermined level.

26. A valve assembly as set forth in claim 21 wherein said valve means has means responsive to an external control signal.

27. A valve assembly as set forth in claim 21 wherein said single pilot valve means has control force generating means responsive to pressure differential across said first control orifice means.

28. A valve assembly as set forth in claim 21 wherein said single pilot valve means has control force generating means responsive to pressure differential across said second control orifice means.

29. A valve assembly as set forth in claim 21 wherein said single pilot valve means has first control force generating means responsive to pressure differential across said first control orifice means and second control force generating means responsive to pressure differential across said second control orifice means.

30. A valve assembly as set forth in claim 21 wherein said single pilot valve means has free floating piston means responsive to pressure differential between said supply chamber and said negative load pressure sensing means.

31. A valve assembly as set forth in claim 21 wherein said positive load pressure sensing means has means operable to transmit positive load pressure signal to said pump.

32. A valve assembly as set forth in claim 21 wherein said force generating means of said second valve means is opposed by a spring biasing means.

* * * * *